US005706665A

United States Patent [19]

Gregory

[11] Patent Number: 5,706,665

[45] Date of Patent: Jan. 13, 1998

[54] REFRIGERATION SYSTEM

[75] Inventor: Charles Gregory, Burlington, Canada

[73] Assignee: Super S.E.E.R. Systems Inc., Burlington, Canada

[21] Appl. No.: 660,349

[22] Filed: Jun. 4, 1996

[51] Int. Cl.[6] ..... F25B 41/00

[52] U.S. Cl. ..... 62/174; 62/509; 62/513

[58] Field of Search ..... 62/174, 513, 509, 62/113, 196.1

[56] References Cited

U.S. PATENT DOCUMENTS

| | | | |
|---|---|---|---|
| 2,120,764 | 6/1938 | Newton | 62/513 X |
| 2,220,726 | 11/1940 | Newcum | 62/513 X |
| 2,359,595 | 10/1944 | Urban | 62/509 X |
| 3,446,032 | 5/1969 | Bottum | 62/513 |
| 3,473,348 | 10/1969 | Bottum | 62/513 |

*Primary Examiner*—Harry B. Tanner

*Attorney, Agent, or Firm*—Rogers & Scott

[57] ABSTRACT

A refrigeration system has a compressor operable to supply compressed refrigerant vapor, a condenser to liquify compressed refrigerant vapour from the compressor, a thermostatic expansion valve to vaporize liquified refrigerant from the condenser, an evaporator to cool the surrounding atmosphere by vaporized refrigerant from the thermostatic expansion valve, a superheat sensor to improve control of the thermostatic expansion valve, a compressor discharge line to convey compressed refrigerant vapour from the compressor to the condenser, a return line to convey liquified refrigerant from the condenser to the expansion valve, and a suction line including the superheat sensor to convey vaporized refrigerant from the evaporator to the compressor. A liquid refrigerant stabilizer in the liquid return line and the suction line is operable to convey liquid refrigerant in the return line and vaporized refrigerant in the suction line in heat exchange relationship with each other to cause liquid refrigerant in the return line to be cooled by vaporized refrigerant in the suction line.

6 Claims, 2 Drawing Sheets

FIG. 1

REFRIGERATION SYSTEM

Figure 1:
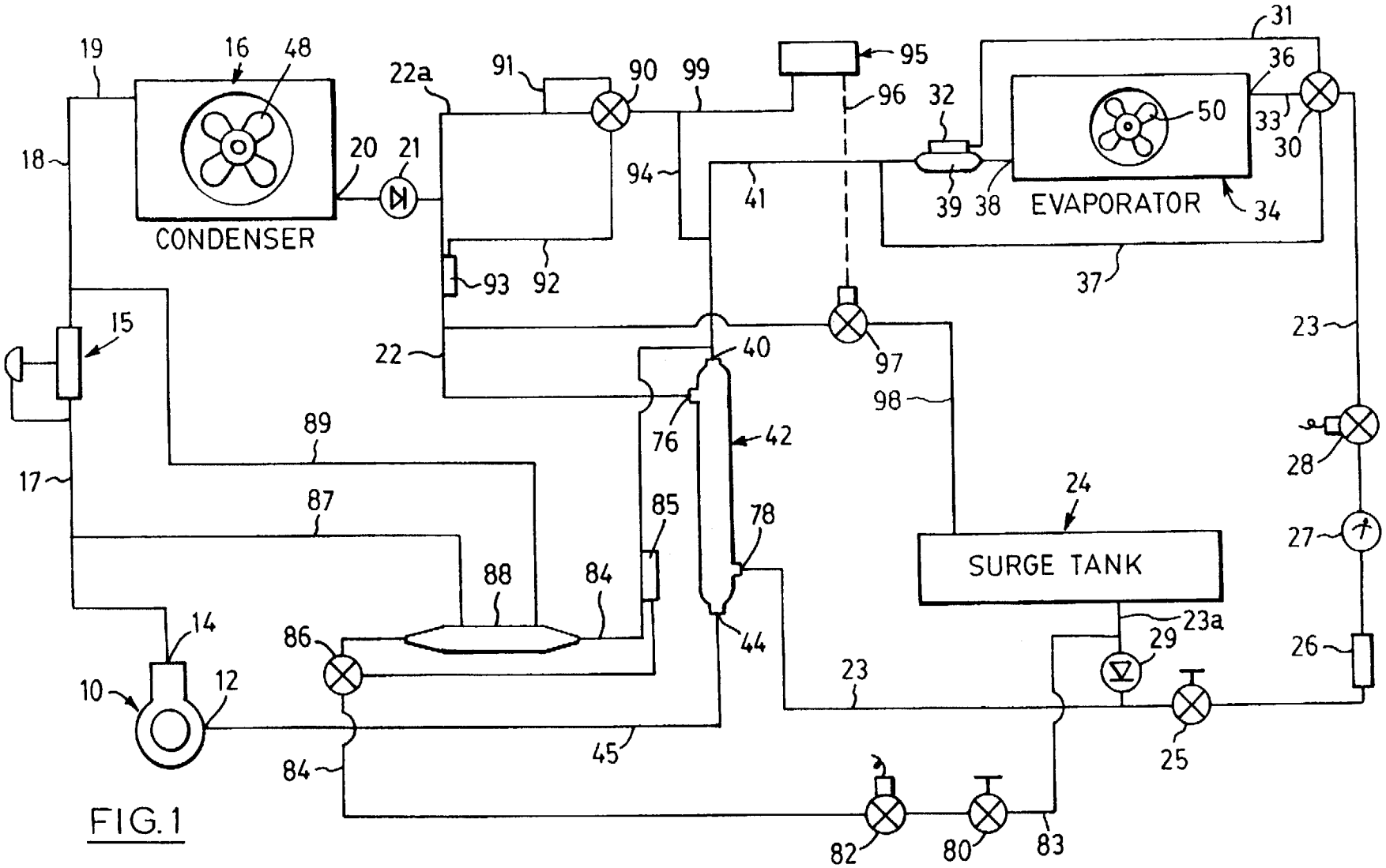

This invention relates to refrigeration systems.

Convention refrigeration systems have a compressor which pumps refrigerant vapour to a condenser where heat is expelled to cause the vapour to condense into liquid refrigerant. The liquid flows through a liquid return line into a receiver tank, where sufficient liquid is stored to maintain a liquid seal for the liquid line through which the liquid refrigerant flows to a thermostatic expansion (TX) valve into an evaporator coil, where pressure is reduced to cause the liquid refrigerant to vaporize and absorb heat. The refrigerant vapour flows through a suction line to the compressor. This is a dynamic closed loop flow, with a change in state of the refrigerant from vapour to liquid emitting heat, then from liquid to vapour absorbing heat.

The efficiency of a refrigeration system decreases as the compressor discharge head pressure increases. For example, one manufacture's capacity tables show that a 3 H.P. system using Freon 22 with a saturated evaporator temperature of 20° F. (which is equivalent to 43 lbs. pressure) and a discharge pressure of 144 lbs. would remove 43,000 BTU of heat per hr. using 3.5 kilowatts of energy. At a discharge pressure of 260 lbs., the cooling capacity would be reduced to 28,000 BTU and the energy used would increased to 4.2 KW.

Thus, at 144 lbs discharge pressure, 1 watt removes 12.286 BTU, and at 260 lbs discharge pressure, 1 watt removes 6.667 BTU. It will thus be seen that, the lower the operating discharge pressure, the higher the system efficiency.

In conventional refrigeration systems the TX valve which controls the supply of refrigerant to the evaporator cooling coil is sized in a very narrow operating range. For example, there are eight differently sized valves from ⅕ to 2 tons capacity, with a pressure difference of up to 175 lbs. across the valve, requiring a high operating compressor discharge pressure to force enough refrigerant through the TX valve orifice.

In colder weather, to maintain this high operating head pressure, a portion of the condenser tubes is filled with liquid refrigerant to decrease the condenser capacity. This winter charge can be almost as much as the summer operating charge. This surplus refrigerant is stored in the receiver.

This high head pressure is required to force enough liquid refrigerant through the small orifice in the closely sized TX valve. If the head pressure is reduced, not enough refrigerant will pass through the valve orifice to fully flood the cooling coil. TX valve manufacturers warn users not to oversize the TX valve for fear of losing control and causing compressor damage. Also, the liquid seal in the refrigerant receiver is required to stabilize the liquid refrigerant and ensure a solid column of liquid refrigerant to the TX valve inlet.

It is therefore an object of the present invention to provide an improved refrigeration system with reduced refrigerant requirements and energy consumption compared to conventional refrigeration systems of the kind described above.

The present invention provides a refrigeration system comprising a compressor operable to supply compressed refrigerant vapor, a condenser to liquify compressed refrigerant vapour from the compressor, a thermostatic expansion valve to vaporize liquified refrigerant from the condenser, an evaporator to cool the surrounding atmosphere by vaporized refrigerant from the thermostatic expansion valve, a superheat sensor to improve control of the thermostatic expansion valve, a compressor discharge line to convey compressed refrigerant vapour from the compressor to the condenser, a return line to convey liquified refrigerant from the condenser to the expansion valve, a suction line including said superheat sensor to convey vaporized refrigerant from the evaporator to the compressor, and a liquid refrigerant stabilizer in said liquid return line and said suction line operable to convey liquid refrigerant in said return line and vaporized refrigerant in said suction line in heat exchange relationship with each other to cause liquid refrigerant in said return line to be cooled by vaporized refrigerant in said suction line.

Advantageously, the thermostatic expansion valve with the superheat sensor has a capacity at least twice that of the evaporator, i.e. at least twice the normally recommended size.

The refrigeration system may also include a surge tank, a drain line connected between a portion of the return line upstream of the stabilizer and the surge tank, and a surge line connected between the surge tank and a portion of the suction line downstream of the stabilizer. A non-return valve may be provided in the surge line between the surge tank and the return line downstream of the stabilizer to prevent flow of refrigerant from the return line through the surge line to the surge tank.

The refrigerant system may also include a shut-off valve in the drain line between the return line upstream of the stabilizer and the surge tank, and a temperature sensor to sense the temperature of refrigerant in the return line between the condenser and the stabilizer and operable to open said shut-off valve when said temperature is below a pre-determined value and close the shut-off valve when the temperature is above a pre-determined value relative to the saturated temperature of the refrigerant in the condenser.

The refrigeration system may also include a make-up line connected between a portion of the surge line between the surge tank and the non-return valve and the suction line upstream of the stabilizer for supplying a regulated amount of refrigerant from the surge tank to the suction line, said make-up line including a make-up thermostatic expansion valve and a vaporizer in the make-up line between the make-up expansion valve and the suction line upstream of the stabilizer, said vaporizer also being connected to the compressor discharge line to cause compressed refrigerant vapor therefrom to be brought in heat exchange relationship with refrigerant in the make-up line, and a temperature sensor to sense refrigerant temperature in the make-up line downstream of the vaporizer to sense the temperature of the refrigerant in the make-up line and control the make-up expansion valve to ensure that refrigeration supplied by the make-up line to the suction line is primarily vapor, i.e. superheated.

The stabilizer is preferably constructed to cause the suction line vaporized refrigerant to have turbulent flow during heat exchange relationship with the return line liquid refrigerant, whereby the liquid refrigerant is influenced by the total mass of the suction line vaporized refrigerant.

Figure 2:
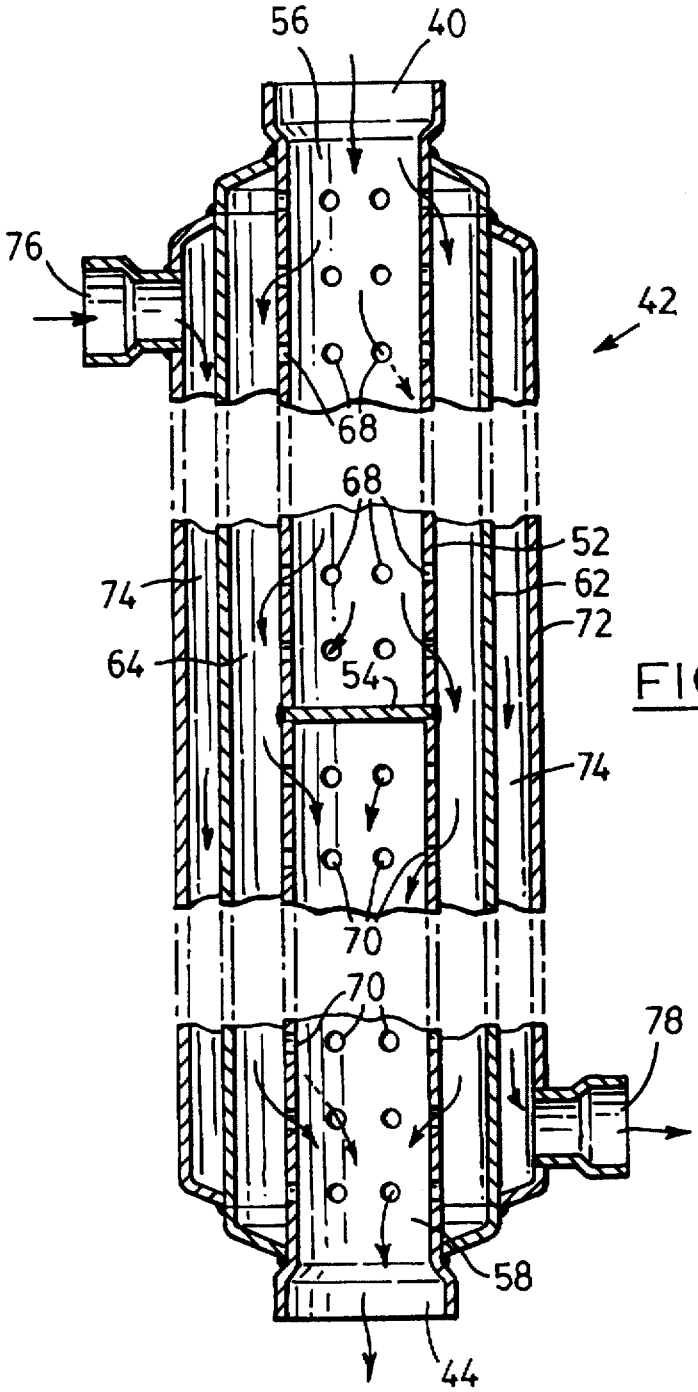

One embodiment of the invention will now be described, by way of example, with reference to the accompanying drawings, of which:

FIG. 1 is a schematic circuit diagram of a refrigeration system in accordance with one embodiment of the invention, and FIG. 2 is a longitudinal cross-sectional view of the liquid refrigerant stabilizer used in the circuit of FIG. 1.

Referring to the drawings, FIG. 1 shows a refrigeration system with a compressor 10 having a suction inlet 12 and a high pressure outlet 14 with a discharge line 17 connected to the inlet of a pressure regulating valve 15. A discharge line 18 from the pressure regulating valve 15 is connected to the inlet 19 of a refrigerant condenser coil 16, the outlet 20 of which is connected by line 22 with a check valve 21 to the inlet 76 of a full flow liquid refrigerant stabilizer 42. The outlet 78 of the stabilizer 42 is connected by line 23 with a shut-off valve 25, a drier 26, an indicator 27, and a solenoid valve 28 to a thermostatic expansion (TX) valve 30, which is connected by a line 33 to the inlet 36 of an evaporator cooling coil 34. The TX valve 30 has a capacity at least twice that of the evaporator cooling coil 34.

The cooling coil 34 has an outlet 38 connected to a superheat sensor 39 and then through suction line 41 to the refrigerant inlet 40 of the liquid refrigerant stabilizer 42. The TX valve 30 has a temperature sensing valve 32 attached to the superheat sensor 39 to improve control of the TX valve 30 in known manner. The stabilizer 42 has a refrigerant outlet 44 connected by suction line 45 to the suction inlet 12 of compressor 10 to complete the circuit.

In use, hot compressed gas from the compressor 10 is condensed in condenser coil 16, which has a fan 48 to pass cooling air over and through the finned heat exchange structure (not shown) of the coil 16. The resultant liquid refrigerant leaves the coil 16 at outlet 20 and then passes through line 22 into the inlet 76 of the liquid refrigerant stabilizer 42, exiting at outlet 78 into liquid line 23. A surge line 23*a* with a check valve 29 connects liquid line 23 to the bottom of a surge tank 24 which holds any surplus refrigerant liquid, for example liquid refrigerant required to maintain discharge head pressure during winter operation by flooding a portion of condenser 16, as controlled by inlet pressure regulator 15 and check valve 21.

With valves 25 and 28 open, liquid refrigerant expands to vapor through the expansion valve 30 and passes into the cooling coil 34 to cool the coil and consequently cool the adjacent space, with air to be cooled being circulated over the coil 34 by a fan 50. The refrigerant vapour then passes through the superheat sensor 39, line 41 and liquid refrigerant stabilizer 42, as will be described in more detail later, and then returns to the compressor inlet 12 through the suction line 45.

The construction of the liquid refrigerant stabilizer 42 will now be described with reference to FIG. 2. The stabilizer 42 is made of metal, preferably high conductivity metal such as copper or brass, and has an inner cylindrical pipe 52 provided at the middle of its length with a transversely-extending circular disc 54 forming a barrier extending over the entire cross-sectional area of the pipe 52 and dividing the pipe interior into two separate cylindrical chambers 56, 58, which will be referred to for convenience of terminology as the first and third chambers. One end of pipe 52 constitutes the inlet 40, while the other end constitutes the outlet 44.

The barrier disc 54 may be fastened into the interior of the pipe in any suitable manner or alternatively, as illustrated, it may be a connecting member between two co-axial pipe portions which together form the pipe 52. The barrier provided by disc 54 does not have to be absolutely gas tight between the first and the third chambers 56, 58. An intermediate cylindrical pipe 62 of larger diameter than the pipe 52 surrounds the first pipe 52 co-axially therewith and is sealed to the pipe 52 at both ends which are turned radially inwardly, thereby forming a second chamber 64 with an annular cross-section between the two pipes 52, 62.

Fast flowing refrigerant vapor entering the innermost pipe 52 through inlet 40 from the cooling coil 34 impinges strongly against the transverse barrier 54 and immediately becomes extremely turbulent within the first chamber 56. The pipe 52 has a first series of apertures 68 distributed uniformly along the part of its length forming the first chamber 56, and also distributed uniformly around its periphery. The apertures 68 direct the turbulent refrigerant vapour from the chamber 56, together with any liquid entrained therein, forcefully into the annular second chamber 64 and against the inner wall of the intermediate pipe 62.

The pipe 52 has another series of apertures 70 similarly uniformly distributed along the part of its length forming the second chamber 58 and around its periphery. The apertures 70 direct the highly turbulent vapour in the annular second chamber 64 into the third chamber 58 and out of the outlet 44. The abrupt change of direction of the vapour required for its passage through the second series of apertures 70 considerably increases its turbulence in the third chamber 58.

An outermost cylindrical pipe 72 co-axial with the pipes 52, 62 surrounds at least that portion of the intermediate pipe 62 adjacent the location of the apertures 68 and 70, and has its ends radially inwardly turned and sealed to the pipe 62 so as to define an annular fourth chamber 74 surrounding the pipe 62. The liquid refrigerant inlet 76 is adjacent one end of the pipe 72 and the outlet 78 is adjacent the other end thereof, so that the liquid refrigerant fluid from the condenser 16 can be passed through the chamber 74 in heat exchange contact with as much as possible of the outer wall of the heat-conductive pipe 62. The liquid refrigerant in chamber 74 is cooled by the pipe 62 against which the refrigerant vapor impinges after pressure through apertures 68, and with which the resultant turbulent vapor remains in contact as it passes through the annular second chamber 64 towards the other set of apertures 70, resulting in complete and substantially immediate evaporation of any fine droplets in the turbulent vapor. The vapor in the chamber 64, now droplet-free, passes through the apertures 70 into the third chamber 58 and exits through outlet 44 to pass through suction line 45 to the compressor inlet 12.

The dimensions of the three pipes 52, 62, 72 and of the apertures 68, 70 relative to each other are important for optimum functioning of the stabilizer 42. The pipe 52 is preferably of at least the same internal diameter as the suction line 45 to the compressor 10, so that it is of the same cross-sectional flow area and capacity. The number and size of the apertures 68, 70 should be chosen so that the cross-sectional flow area provided by all the apertures is not less than about half of the cross-sectional area of the pipe 52, and preferably is about equal to or slightly larger than that area. The total cross-sectional area of the apertures 68, 70 need not be greater than about 1.5 times the cross-sectional area of the pipe 52, since increasing the ratio beyond this value has very little corresponding increased beneficial effect, if any. Moreover, each individual aperture 68, 70 should not be too large. If a larger flow area is required, it is preferable to provide this by increasing the number of apertures.

As described above, the purpose of the apertures 68 is to direct the flow of refrigerant vapor radially outwardly into impingement contact with the inner wall of the pipe 62, and this purpose may not be sufficiently achieved if the apertures 68 are too large. The apertures 68 should be uniformly distributed along and around the respective portion of the pipe 52 to maximize the area of the adjacent portion of the wall of pipe 62 that is contacted by the vapor issuing from the apertures 68. Thus, the liquid refrigerant in chamber 34 is influenced by the total mass of the suction line vaporized refrigerant.

It is also important that the cross-sectional flow area of the second annular chamber 64 be not less than about half of the corresponding flow area of the pipe 52. Again, the areas are preferably approximately equal, with the possibility of the area of annular chamber 64 being slightly greater than that of pipe 52, the preferred maximum ratio again being about 1.5. The diameter of the pipe 72 should be sufficiently greater than that of the pipe 62 so that the cross-sectional flow area of the annular chamber 74 is not less than that of line 22 from the condenser outlet 20 to the stabilizer inlet 76. The cross-sectional flow area of the annular chamber 74 may be up to about 1.5 times larger than that of return line 22. The inlet 76 to the chamber 74 and the outlet 78 therefrom should of course be of sufficient size so as not to throttle the flow of fluid therethrough.

It will be understood by those skilled in the art that, when the stabilizer 42 is constructed in this manner, it will appear to the remainder of the system during normal cooling operation as nothing more than another portion of the suction line 45, or at most a minor constriction or expansion thereof with insufficient change in flow capacity to vary the characteristics of the system significantly. The system can therefore be designed without regard to this particular flow characteristic of the stabilizer 42. It will also be noted that the stabilizer 42 can be incorporated by retrofitting into the piping of an existing refrigeration system without causing any unacceptable changes in the flow characteristics of the system.

To maintain the minimum refrigerant charge in equilibrium and to clear the surge tank 24 of any surplus refrigerant, a small bleed line 83 extends from surge line **23*a* between the surge tank 24 and check valve 29 through a manually operable needle control valve 80 and a solenoid valve 82 to a line 84 with a small TX valve 86 and a small (½") vaporizer 88 to suction line 41. A small amount of liquid refrigerant is taken from the surge tank 24, as controlled by the setting of needle valve 80, vaporized by TX valve 86 and vaporizer 88 and fed back into the refrigeration cycle loop. TX valve 86 is controlled by temperature sensor bulb 85 secured to line 84 between the vaporizer 88 and line 41 so as to sense temperature in that portion of line 84. The vaporizer 88 is heated by discharge vapour flowing through lines 87, 89 which are connected to compressor discharge lines 17, 18 respectively. The optimum flow can be set by adjusting needle valve 80. The solenoid valve 82** is closed when the system is shut down.

In conjunction with the liquid refrigerant bleed system described above, a minimum amount of refrigerant in the cooling system is maintained by controlling the amount of sub-cooling of the liquid refrigerant leaving condenser 16.

This is effected by use of a thermostatic expansion (TX) valve 90 whose inlet is connected by line **22*a* to the liquid return line 22 from condenser 16. An equalizer line 91 from valve 90 is connected to line 22*a*. Thus the actuating element of TX valve 90 reacts through line 91 to the pressure in lines 22, 22*a*, and the temperature sensor bulb 93 of TX valve 90 connected thereto by line 92 is secured to line 22** so as to sense its temperature.

The outlet of TX valve 90 is connected by a 0.25 inch line 99 to a pressure control 95. A small bore capillary line 94, for example 16 feet of 0.026 inch bore tube, extends from line 99 to suction line 41.

If there is no sub-cooling, sensor bulb 93 will cause TX valve 90 to open, thereby allowing liquid refrigerant to flow into line 99 to pressure control 95. Pressure will rise in line 99 because of restricted flow through capillary line 94. The increase in pressure in line 99 causes pressure control 95 to open an electrical circuit (indicated by dotted line 96) to and thereby close a solenoid shut-off valve 97 in drain line 98. The refrigerant bleeding into the system through lines 83, 84 into the suction line 41 will fill the bottom condenser tubes, sub-cooling the liquid refrigerant in return line 22 and sub-cooling TX valve sensor 93, thereby closing TX valve 90. Pressure in line 99 then bleeds off through capillary line 94, causing pressure control 95 to close the electrical circuit to and open solenoid valve 97.

Surplus refrigerant in condenser 16 flows to surge tank 24 from return line 22 through drain line 98 when solenoid valve 97 is open. When enough refrigerant is removed, sub-cooling will decrease and line 22 will warm up. This is sensed by sensor bulb 93, thereby opening TX valve 90. This increases pressure in line 99 to cause pressure control 95 to close solenoid valve 97, thus repeating the cycle described above.

Thus, the sensor bulb 93 is operable to open the shut-off valve 97 when the temperature sensed is below a predetermined value and to close the shut-off valve 97 when the temperature sensed is above a predetermined value relative to the saturated temperature of the refrigerant in the condenser. This is a continuous process, maintaining refrigerant in the system very close to an optimum amount. The small amount of liquid refrigerant fed into the system through capillary line 94 is not wasted, since it assists in cooling and stabilizing the liquid refrigerant flowing through the outer chamber 74 of stabilizer 42.

By using a larger TX valve 30 with a superheat sensor 32, the TX valve 30 may be operated with superheat less than 5° F., usually about 2° F., instead of 10° F. which has previously been conventional. This results in more of the cooling coil 16 being used to actively absorb latent heat instead of superheating the vapour. This larger active coil surface results in the required air temperature in the ambient atmosphere being attained with less temperature difference between the saturated temperature of the refrigerant and the ambient air temperature, e.g. the temperature of a cooler or freezer. This results in a higher saturated suction temperature, with the subsequently denser suction refrigerant vapour increasing compressor efficiency.

This is shown by the following example using the same 3HP compressor as in the effect of head pressure example mentioned earlier.

The head (discharge) pressure is 144 lbs. in both cases. At 20° F. (43 lbs.) suction temperature, 43,000 BTU of heat are removed in one hr. using 3.5 KW. of power. At 30° F. (55 lbs.) suction temperature, 59,000 BTU are removed in one hr. using 3.7 KW. Thus, at 20° F., suction temperature, 1 watt removes 12.286 BTHU. At 30° F. suction temperature, 1 watt removes 15.946 BTU.

This is an increase of 29.19% in operating efficiency, with consequent reduced operating costs. Capital costs will also be reduced by utilizing smaller compressors if the operating suction pressure is increased.

A refrigeration system using an upsized TX valve with a superheat sensor will handle increased cooling loads much more efficiently and quickly than a system with a standard sized TX valve.

The capacity of a cooling coil is based on the temperature difference (T.D.) between the air passing over the cooling coil and the saturated temperature of the refrigerant in the coil. 10° F. is the design T.D. used to rate cooling coil capacity. If the air passing over the coil is 20 degrees warmer than the coil due to an increase in load, the coil will have a cooling capacity twice the capacity at a 10 degrees T.D. The upsized TX valve with a superheat sensor will supply enough refrigerant to flood the whole coil and lower ambient temperature in a cooler or freezer to the desired operating temperature much more quickly.

In a specific embodiment intended for a refrigeration system employing a 7.5–10 H.P. motor, the stabilizer 42 has a length of about 65 cm. (26 in.). The inner pipe 52 is copper of 3.4 cm. (1.325 in.) outside diameter (O.D.), and the middle pipe 62 is also copper of 5.3 cm (2.125 in.) O.D. The pipe 52 is provided with two separate sets of 48 uniformly distributed apertures, each 4.8 mm. (0.1875 in.) in diameter, to provide a total of 96 apertures. The outermost pipe 72 has a length of 60 cm. (24 in.) and an O.D. of 6.56 cm (2.625 in.), while the return line 22 has a diameter of 2.18 cm. (0.875 in.).

Other embodiments of the invention will be readily apparent to a person skilled in the art, the scope of the invention being defined in the appended claims.

I claim:

1. A refrigeration system comprising a compressor operable to supply compressed refrigerant vapour, a condenser to liquify compressed refrigerant vapour from the compressor, a thermostatic expansion valve to vaporize liquified refrigerant from the condenser, an evaporator to cool the surrounding atmosphere by vaporized refrigerant from the thermostatic expansion valve, a superheat sensor to improve control of the thermostatic expansion valve, a compressor discharge line to convey compressed refrigerant vapour from the compressor to the condenser, a return line to convey liquified refrigerant from the condenser to the expansion valve, a suction line including said superheat sensor to convey vaporized refrigerant from the evaporator to the compressor, a liquid refrigerant stabilizer in said liquid return line and said suction line operable to convey liquid refrigerant in said return line and vaporized refrigerant in said suction line in heat exchange relationships with each other to cause liquid refrigerant in said return line to be cooled by vaporized refrigerant in said suction line, a surge tank, a drain line connected between a portion of the return line upstream of the stabilizer and the surge tank, and a surge line connected between the surge tank and a portion of the return line downstream of the stabilizer, a shut-off valve in the drain line between the return line upstream of the stabilizer and the surge tank, and a temperature sensor to sense temperature of refrigerant in the return line between the condenser and the stabilizer and operable to open said shut-off valve when said temperature is below a pre-determined value and close the shut-off valve when the temperature is above a pre-determined value relative to the saturated temperature of the refrigerant in the condenser.

2. A refrigeration system according to claim 1 wherein the thermostatic expansion valve with said superheat sensor has a capacity at least twice that of the evaporator.

3. A refrigeration system according to claim 1 also including a non-return valve in the surge line between the surge tank and the return line downstream of the stabilizer to prevent flow of refrigerant from the return line through the surge line into the surge tank.

4. A refrigeration system according to claim 1 also including a make-up line connected between a portion of the surge line between the surge tank and the non-return valve and the suction line upstream of the stabilizer for supplying a regulated amount of refrigeration from the surge tank to the suction line, said make-up line including a make-up expansion valve and a vaporizer in the make-up line between the make-up expansion valve and the suction line upstream of the stabilizer, said vaporizer also being connected to the compressor discharge line to cause compressed refrigerant vapor therefrom to be brought in heat exchange relationship with refrigerant in the make-up line, and a temperature sensor to sense refrigerant temperature in the make-up line downstream of the vaporizer to sense the temperature of the refrigerant in the make-up line and control the make-up expansion valve to ensure that refrigerant supplied by the make-up line to the suction line is primarily vapor.

5. A refrigeration system according to claim 1 wherein the stabilizer is constructed to cause the suction line vaporized refrigerant to have turbulent flow during heat exchange relationship with the return line liquid refrigerant, whereby the liquid refrigerant is influenced by the total mass of the suction line vaporized refrigerant.

6. A refrigeration system according to claim 5 wherein the stabilizer comprises an inner cylindrical pipe with a transverse barrier at the middle of its length forming first and second chambers on opposite sides thereof, the inner pipe having an inlet at one end receiving refrigerant vapour from the evaporator and an outlet at the other end from which refrigerant vapour flows to the compressor, an intermediate cylindrical pipe surrounding the first pipe and sealed thereto at both ends to form a third chamber between the intermediate and inner pipes, the inner pipe having a first series of apertures in the first chamber and another series of apertures in the second chamber, and an outer cylindrical pipe surrounding the intermediate pipe and sealed thereto at opposite ends to form a fourth chamber, the fourth chamber having an inlet receiving refrigerant liquid from the condenser and an outlet from which refrigerant liquid flows to the thermal expansion valve, whereby refrigerant vapour together with any liquid entrained therein from the evaporator in the first chamber impinges against the transverse barrier and passes turbulently through the first series of apertures into the third chamber and against the intermediate pipe to effect heat exchange with refrigerant liquid in the fourth chamber and then pass through the second series of apertures into the second chamber and then to the compressor.

* * * * *